United States Patent [19]

Rattner

[11] Patent Number: 4,634,373

[45] Date of Patent: Jan. 6, 1987

[54] GAS-FIRED RADIANT HEATER

[76] Inventor: David Rattner, Box 104, Solebury, Pa. 18963

[21] Appl. No.: 779,626

[22] Filed: Sep. 24, 1985

[51] Int. Cl.[4] ..... F23D 13/12

[52] U.S. Cl. ..... 431/328; 126/92 AC

[58] Field of Search ..... 431/326, 328, 329; 126/92 R, 92 AC; 432/8, 31, 59, 226

[56] References Cited

U.S. PATENT DOCUMENTS

| | | | |
|---|---|---|---|
| 3,008,513 | 11/1961 | Holden | 431/328 |
| 3,167,110 | 1/1965 | Szell | 431/328 |
| 3,200,874 | 8/1965 | Koppel | 431/329 |
| 3,805,763 | 4/1974 | Cowan | 126/92 R |
| 4,039,275 | 8/1977 | McGettrick | 431/329 |
| 4,255,123 | 3/1981 | Bishilany | 431/328 |
| 4,373,904 | 2/1983 | Smith | 431/328 |
| 4,378,207 | 3/1983 | Smith | 432/8 |
| 4,435,155 | 3/1984 | Vigneau | 431/328 |
| 4,492,564 | 1/1985 | Wolf | 431/328 |

FOREIGN PATENT DOCUMENTS

| | | | |
|---|---|---|---|
| 2006948 | 5/1979 | United Kingdom | 431/328 |

*Primary Examiner*—Margaret A. Focarino
*Attorney, Agent, or Firm*—Robert J. Mooney; Armand M. Vozzo, Jr.

[57] ABSTRACT

An improved gas-fired radiant heater is disclosed, particularly useful in drying continuous web materials, wherein a partially compartmentalized manifold chamber is formed beneath an extended series of porous ceramic tiles for evenly distributing a predetermined gas-air mixture of fuel so that upon ignition there is provided a continuous burning surface along the entire length of the tiles. A plurality of baffle members are disposed throughout an elongated manifold housing to compartmentalize lower portions of the manifold chamber and thereby permit the proper flow of fuel through the heater to generate a more uniform radiant heat field. An air jacket assembly surrounding the manifold chamber is further provided and includes an outer casing into which cooling air is injected and circulated throughout the length of the heater. The casing is formed to provide an elongated air gap along either side of the tiles and an angled deflector is mounted over and above each air gap to vent and direct the circulated air away from the radiant tiles for better and more efficient cooling of the heater structure. In a system configuration, a plurality of the heaters are parallelly mounted and disposed oppositely facing each other in a staggered arrangement for effective drying of the web material when passed therethrough.

19 Claims, 4 Drawing Figures

GAS-FIRED RADIANT HEATER

BACKGROUND OF THE INVENTION

The present invention relates to gas-fired radiant heaters commonly employed in large industrial ovens, and more particularly to an improved radiant heater having a partially compartmentalized fuel distribution system for more uniform heat radiation throughout extended heater lengths and a specially configured air jacket for directing the flow of cooling air within and about the heater structure.

In industrial process heating applications, gas-fired, infra-red heaters are commonly employed in ovens for heating or drying webs of large surface areas. The webs are typically moved through the ovens in proximity to and across the radiant face of the heater which generally comprises a plurality of porous refractory panels mounted upon associated supporting structure. Through the panels a gaseous combustible fuel mixture is passed and the mixture is ignited on the face of the panels causing them to become incandescent and generate infra-red radiation that effectively heats and dries the moving webs.

Extremely high temperatures are achieved as the fuel mixture ignites on the face of the panels. Although most of this heat energy is directed toward the web, a significant portion of it raises the temperature of the supporting structure to an elevated level at which distortion of the supporting structure may occur with accompanying damage to the panels as well as the structure. Such distortion significantly affects the heating and drying of webs and typically requires a shut-down of the operation and the costly repair or replacement of the heaters prior to resumption of normal processing. While current gas-fired, infra-red heaters have generally provided for the circulation of cooling air within and about their supporting structure to reduce its temperature and the consequent risk of distortion, there still remains a need for a more efficient means of cooling the support structure without adversely affecting the radiant heat field generated by the refractory panels and without diminishing the amount of heat applied to the moving web.

Another area of major concern in the effective operation of these infra-red heaters is the even distribution of the fuel mixture along extended lengths so that a substantially uniform incandescence may be maintained along the surfaces of the refractory panels. Generally required in order to properly heat the very large surface areas of the webs, relatively long heaters of 80 inches or more are commonly employed, and an uneven distribution of fuel mixture throughout these extended lengths will result in "cold spots" along the panels and gaps in the radiant heat field applied to the webs. Existing infra-red heaters, particularly their supporting structures, are fabricated from expensive cast iron parts extremely difficult and costly to produce in comparatively long sections. As a result, short cast iron sections, typically of no more than 12 inches, are bolted or otherwise joined together to form a row of heaters of a desired length. While such multiple-sectioned structures have generally provided effective infra-red heat radiation, they can be a cause of "cold spots" and gaps in the radiant heat field, particularly where the sections are joined, and otherwise, remain very expensive and difficult to fabricate.

SUMMARY OF THE INVENTION

Accordingly, it is a general purpose and object of the present invention to provide an improved gas-fired, infra-red generator for use in industrial ovens to heat-treat and dry continuous web material.

A more particular object of the present invention is to provide an improved construction for a gas-fired radiant heater that more effectively cools the non-radiating supporting structure of the heater so as to prevent structural distortion and premature failure of the heater without adversely affecting the radiant heat field being generated.

Another object of the present invention is to provide a gas-fired radiant heater construction that more evenly distributes an ignitable fuel mixture along extended lengths of the heater to reduce and eliminate "cold spots" and gaps in the heat field radiated thereby.

A further object of the present invention is to provide a gas-fired radiant heater for industrial heating applications that is more reliable in operation yet less expensive to manufacture than existing heater designs.

Briefly, these and other objects of the present invention are accomplished by an improved gas-fired radiant heater, particularly useful in drying continuous web materials, wherein a partially compartmentalized manifold is formed beneath an extended series of porous ceramic tiles for evenly distributing a predetermined gas-air mixture of fuel so that upon ignition there is provided a continuous burning surface along the entire length of the tiles. A plurality of baffle members are disposed throughout an elongated manifold housing to comparmentalize lower portions of the manifold chamber and thereby permit the proper flow of fuel through the heater to generate a more uniform radiant heat field. An air jacket assembly surrounding the manifold chamber is further provided and includes an outer casing into which cooling air is injected and circulated throughout the length of the heater. The casing is formed to provide an elongated air gap along either side of the tiles and an angled deflector is mounted over and above each air gap to vent and direct the circulated air away from the radiant tiles for better and more efficient cooling of the heater structure. In a system configuration, a plurality of the heaters are parallelly mounted and disposed oppositely facing each other in a staggered arrangement to permit the web to be effectively dried when passed closely therethrough.

For a better understanding of these and other aspects of the present invention, reference may be made to the following detailed description taken in conjunction with the accompanying drawing in which like reference numerals designate like parts throughout the figures thereof.

DESCRIPTION OF THE PREFERRED EMBODIMENT

Figure 1:
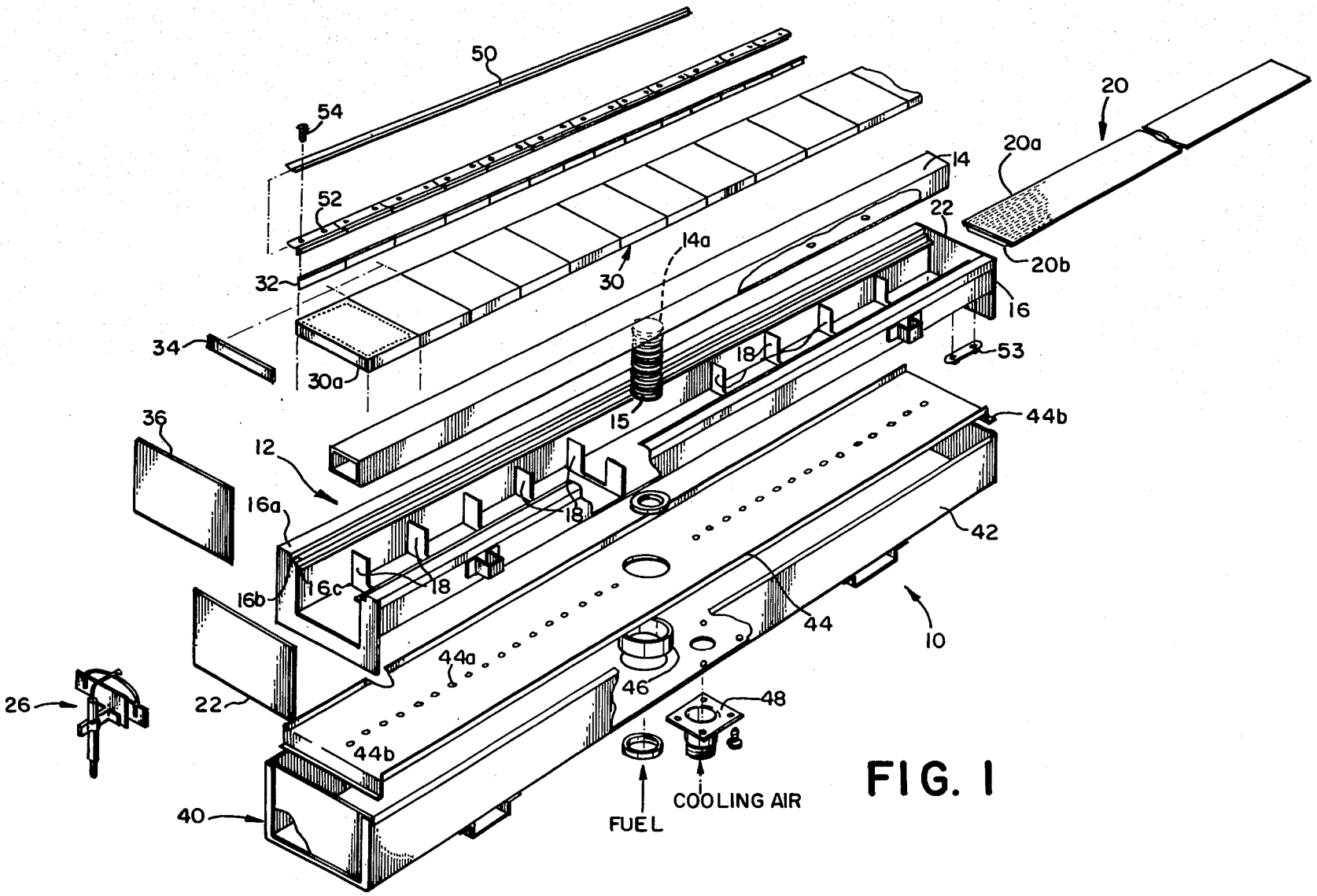
FIG. 1 is an exploded view in perspective of a radiant heater according to the present invention.

Referring now to FIG. 1, there is shown a full view of a gas-fired radiant heater 10 particularly useful in industrial applications requiring the heat-treating or drying of a continuous web material. In accordance with the present invention, radiant heater 10 includes a fuel distribution assembly 12 that delivers a predetermined ignitable fuel mixture of air and gas to a supported ceramic tile assembely 30 for infra-red generation and heat radiation. The tile assembly 30 is comprised essentially of an extended series of porous ceramic tiles 30*a* or similar refractory panels, each rectangularly shaped and grouped together side-by-side in a continuous abutting relationship. The fuel mixture is designed to be fired on the outer surfaces of the ceramic tiles 30*a* by a conventional direct-spark igniter 26 mounted at one end of fuel distribution assembly 12. The radiant heater 10 of the present invention also includes an air jacket assembly 40, described below in greater detail, which substantially encases the fuel distribution and tile assemblies 12 and 30 respectively, and is fed a continuous stream of relatively cool air for improved cooling of the structure supporting the tile assembly.

Major elements of the fuel distribution assembly 12 include a manifold 14, a manifold housing 16 and a diffuser screen assembly 20. Manifold 14 is an elongated rectangular duct-like member having closed ends and may be fabricated from a sheet metal material. The bottom of the manifold 14 is provided with a fuel inlet opening 14*a* near the middle of the manifold and with a series of smaller outlet holes 14*b* along its length. The outlet holes 14*b* correspond in number to that of the ceramic tiles 30*a* and are regularly spaced apart substantially along the centerline of manifold 14. At the fuel inlet opening 14*a*, a tubular coupling 15 may be attached to the bottom of manifold 14 to provide fuel flow to the manifold from the exterior of heater 10.

Manifold housing 16 is an elongated U-shaped channel within which the manifold 14 is mounted and substantially enclosed. Similarly to the manifold 14, housing 16 may be fabricated from a sheet metal material. Throughout the lower portion of manifold housing 16, a series of regularly spaced U-shaped baffles 18 are transversely disposed substantially in parallel to each other and are secured to the interior sides and bottom of the housing.

In accordance with the present invention, manifold 14 rests snugly within and extends across the series of baffles 18 near the bottom of manifold housing 16, the bottom of housing being adapted to accept penetration by tubular coupling 15. The manifold 14 is vertically spaced apart from the bottom of housing 16 by the baffles 18 and is longitudinally disposed relative thereto so that the respective fuel outlet holes 14*b* are substantially centered between adjacent baffles. Separate fuel compartments are thus formed within and along a lower portion of the manifold housing 16 by and between adjacent baffles 18 intersected by the outer walls of manifold 14 for more effective fuel mixing within the compartments and distribution therethrough along the extended length of heater 10 above the manifold.

The diffuser screen assembly 20 consists of a pair of finely meshed screens, an upper screen 20*a* and lower screen 20*b*, which are slightly spaced apart and mounted together above manifold 14 near the top of manifold housing 16. An interior ledge 16*c* extending the entire length of manifold housing 16 on each side thereof supports the diffuser screen assembly 20 in its position above manifold 14. An intermediate ledge 16*b* of similar length and located above the interior ledge 16*c* permits mounting and firm support of the ceramic tile assembly 30 upon manifold housing 16 slightly above and substantially parallel to the position of the diffuser screen assembly 20. It should be noted that relatively thin structural members (not shown) may be employed at various points along the manifold housing 16 to transversely interconnect and thereby support the intermediate ledge 16*b* between the respective ceramic tile and diffuser screen assemblies 30 and 20 so as to prevent individual tiles 30*a* from being dislodged by any excessive outward deflection of the top of the housing structure during operation.

The manifold housing 16 is further provided with a top ledge 16*a* which flatly extends along either side of the housing. The top ledge 16*a* may be adapted to secure a series of flanged clips 52 useful for holding the respective tiles 30*a* firmly in place upon manifold housing 16. In conjunction with the use of the flanged clips 52 which are typically secured to the top ledge 16*a* by a series of screws 54 and associated weld nuts 53, a series of ceramic gasket strips 32 are intermediately disposed between the clips and the sides of the respective tiles 30*a* along the entire length of tile assembly 30. A similar but slightly longer ceramic gasket strip 34 is placed at each end of the tile assembly 30 abutting the transverse dimension of the respective outer tiles 30*a*. The end gasket strips 34 are held in place and the manifold housing 16 is closed at each end thereof by a respective end plate 22 and intermediate ceramic gasket plate 36 firmly secured to the ends of the housing using conventional fastening means. The igniter 26 located at one end of manifold housing 16 is typically secured to the respective end plate 22 and positioned to proved direct spark ignition of the fuel upon the upper surface of the tile assembly 30.

Surrounding the fuel distribution assembly 12 and supported ceramic tile assembly 30, the air jacket assembly 40 includes an elongated outer casing 42, an air distribution plate 44 having a series of regularly spaced holes 44*a* along its length, and a pair of elongated deflectors 50 each mounted longitudinally along a respective upper edge of the outer casing. Fabricated from a sheet metal material, outer casing 42 is a box-like structure adapted along its bottom surface for the inlet of cooling air and is sufficiently sized to permit insertion therein of the entire fuel distribution assembly 12. To allow for such insertion, the bottom of the outer casing 42 should be adapted near its center for the passage therethrough by tubular coupling 15.

Likewise made from sheet metal stock, the air distribution plate 44 is formed having rectangular outer dimensions that permit the plate to snugly fit within outer casing 42. The air distribution plate 44 similarly permitting central passage therethrough by tubular coupling 15, is adapted to rest slightly above and substantially parallel to the bottom of the outer casing 42. In its intended position, the distribution plate 44 is separated from the bottom of outer casing 42 by means of foot pads 44b located on either end of the plate and may be supported at the middle of its length by a spacer 46 through which coupling 15 can pass. An inlet connector 48 coupled to the bottom of outer casing 42 permits the delivery of cooling air to the fuel distribution assembly 12.

Figure 2:
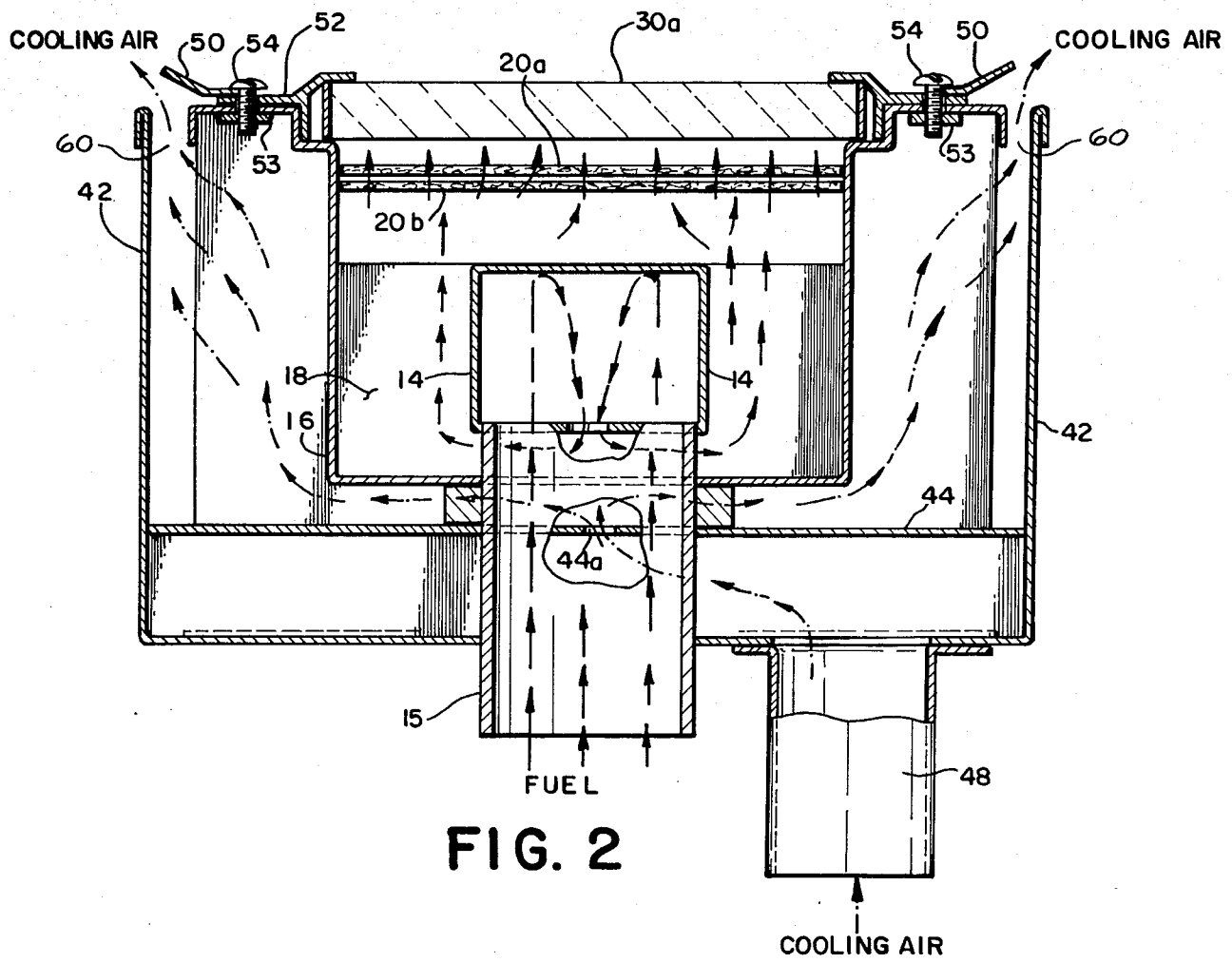
FIG. 2 is a cross-sectional side view of the radiant heater of FIG. 1 with portions cut away.

Wholly fitting within outer casing 42, the manifold housing 16 is designed to rest upon the air distribution plate 44. While the longitudinal dimension of manifold housing 16 is typically made to fit snugly within the corresponding dimension of casing 42, the transverse dimension of the housing is purposely made smaller than that of the casing so that a gap 60, better shown in FIG. 2, is formed between the housing and the casing along their respective upper edges. The width of gap 60 is comparatively small, typically in the range of 1/64 to ⅛ inch, with its length extending alongside the entire length of tile assembly 30. The deflectors 50 are angled, as better shown in FIG. 2, and are mounted above and over the gap 60 on each side of housing 16 so that air passing through the assembled structure and outward from the gap is directed away from the surface of the tile assembly 30. The screws 54 used to secure the flanged clips 52 to the top ledge **16*a* of housing 16 may also be used to hold the deflectors 50 in place above and over the gap 60**.

Figure 3:
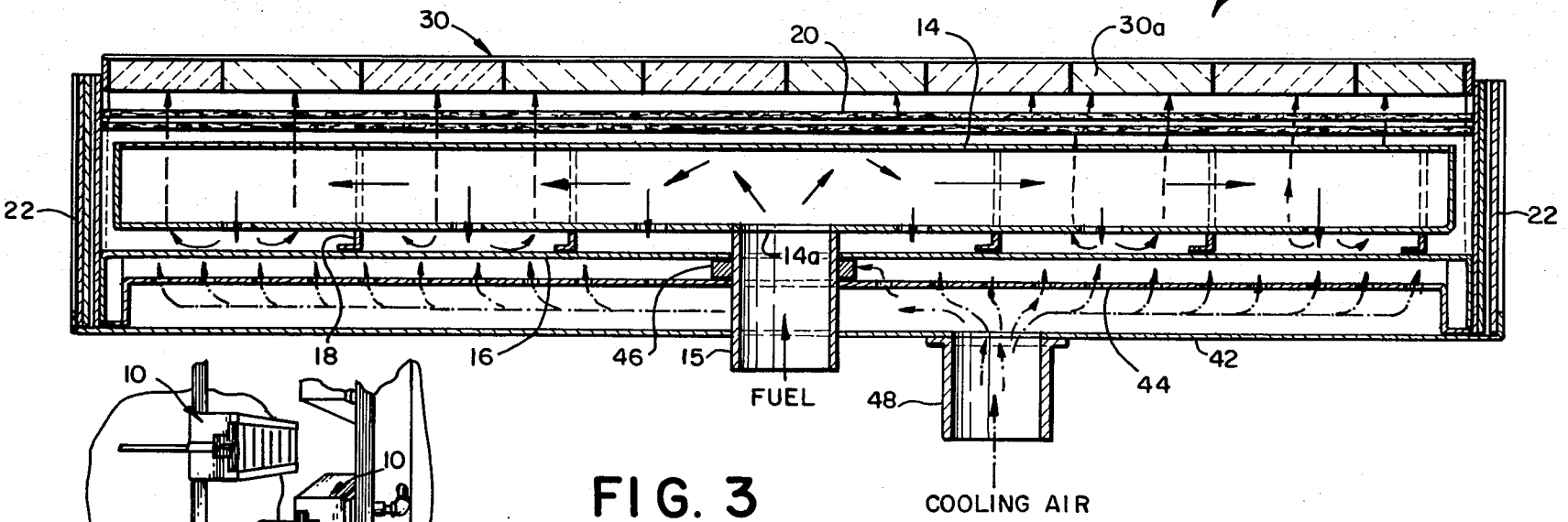
FIG. 3 is a longitudinal view in cross-section of the radiant heater of FIGS. 1 and 2.

Referring now to FIGS. 2 and 3 in conjunction with FIG. 1, the operation of heater 10 can best be explained using solid arrows to indicate fuel flow and segmented arrows to indicate the flow of cooling air. Injected through tubular coupling 15, fuel of a predetermined air/gas mixture is admitted to manifold 14 via its inlet opening **14*a* and is evenly distributed through outlet holes 14*b* to each of the separate fuel compartments formed in the lower portions of manifold housing 16 by the baffles 18 and the external surfaces of the manifold. After impinging upon the bottom of each compartment, the forced fuel stream is redirected upwardly about manifold 14 and through screens 20*a* and 20*b* wherein it is diffused and spread evenly upon the surface of each ceramic tile 30*a* for smooth and uniform burning sparked by igniter 26**.

In its compartmentalized form, the fuel distribution system 12 of heater 10 delivers a uniform stream of fuel to ceramic tile assembly 30 regardless of number of individual tiles **30*a* employed thereby providing an even and continuous burning surface along the entire length of the tiles. Such a compartmentalized arrangement ensures that each tile 30*a*** incandesces upon ignition to substantially the same degree as a neighboring tile thereby eliminating "cold spots" in the radiant field generated.

As for the operation of the air jacket assembly 40 of heater 10, a continuous stream of cooling air is injected into outer casing 42 beneath distribution plate 44 via inlet connector 48 and is directed upwardly through holes **44*a* in the plate so as to envelop the outer surfaces of manifold housing 16 in an evenly distributed blanket of air. As the air blankets and circulates across the relatively hot outer surface of the tile-supporting housing 16, a significant amount of heat is absorbed so that heated air is directed out of casing 42 through the elongated gap 60 formed on either side. The angled deflector 50** directs the heated air away from the radiating surfaces of the incandescent tiles and toward the material being heated.

The provision and placement of the elongated gap 60 in combination with the angled deflector 50 allows the cooling air to be injected into the outer casing 42 at substantially higher pressure than would otherwise be possible. This produces better and more efficient cooling of the support structure of tile assembly 30 without creating a partial vacuum near the edges of the tiles **30*a* and further eliminates "cold spots" in the radiant heat field generated by the tiles. Additionally, in applying continuous streams of heated air to the subject material, usually a wet fabric web being dried, the present heater 10** serves to reduce any water vapor boundary layer formed on the web as it passes the heater thereby improving heat transfer to and water evaporation from the web.

Figure 4:
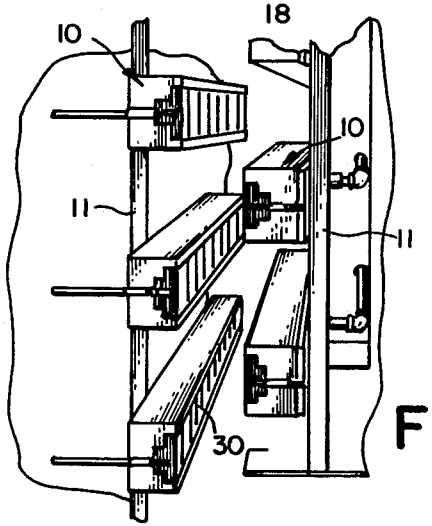
FIG. 4 is a side view in perspective of a plurality of the radiant heaters mounted in a preferred system arrangement.

Referring lastly to FIG. 4, a plurality of the aforedescribed heaters 10 are shown in a preferred system arrangement for drying continuous web material (not shown) adapted for passage thererthrough. A first series of heaters 10, ususally three or more in number, are spaced apart and mounted substantially in parallel to each other upon structural framework 11 typically situated within an insulated enclosure. Each heater 10 in the series is separately coupled to associated sources of fuel and cooling air for proper operation and is secured to framework 11 so that the respective ceramic tile assemblies 30 similarly face outward from its mounting framework to direct its radiant heat field. In such an arrangement, the first series of heaters 10 is made to stand upon its associated framework 11 in proximity to and opposite a second series of heaters 10 similar in number and parallelly mounted in like fashion upon separate framework. Although spaced apart similarly to the first series of heaters 10, the second series of heaters is staggered relative to the opposed series so that the respective ceramic tile assembly 30 of each heater directly faces an intermediate space between the heaters in the opposite series. This opposed and staggered arrangement of heaters 10 subjects the continuous web material in a single pass therethrough to a bidirectional radiated heat field that is evenly but not excessively applied for uniform and effective drying of the web material. It should be understood that greater drying capabilities, as may be required, can be achieved, in accordance with the present invention, by combining a number of the single-pass arrrangements of FIG. 4 in tandem for multi-pass operation.

It should be further understood that independent safety controls (not shown) conventionally employed in conjunction with other gas-fired radiant heating systems may be likewise employed in association with the heater 10 of the present invention. For example, main flame monitoring, which is of primary concern in these types of heating systems due to the associated flow of combustible gases, may be achieved by means of scanning the main flame generated by the heater 10 for its ultra-violet (UV) content. In such a UV scanning system, if the sensed UV content of the main flame, which may be enhanced for scanning purposes, falls to zero or some critically reduced level, standard control switching can be activated to shut off the main fuel flow to heater 10.

Therefore, it is apparent that the disclosed radiant heater provides an improved gas-fired, infra-red generator particularly useful in industrial ovens to heat-treat and dry continuous web material. More particularly, the disclosed invention provides an improved radiant heater construction that more effectively cools the non-radiating supporting structure of the heater so as to prevent structural distortion and premature failure of the heater without adversely affecting the radiant heat field being generated. Furthermore, the disclosed radiant heater more evenly distributes its ignitable fuel mixture along extended lengths to reduce and eliminate "cold spots" and gaps in the radiated heat field. Additionally, the present radiant heater is easier to maintain in clean working condition, and is more reliable in operation yet less expensive to manufacture than other existing radiant heater designs.

Obviously, other embodiments and modification of the present radiant heater will readily come to those of ordinary skill in the art having the benefit of the teachings presented in the foregoing description and drawings. It is therefore to be understood that various changes in the details, materials, steps, and arrangements of parts, which have been described and illustrated to explain the nature of the invention, may be made by those skilled in the art within the principle and scope of the invention as expressed in the appended claims.

I claim:

1. A heater apparatus, comprising:

a plurality of porous tile members arranged in an elongated series;

fuel distribution means adapted to support said tile members and having a baffled compartmentalized chamber transversely integrally formed therein for delivering a predetermined ignitable fuel mixture evenly to said tile members; and air circulation means adapted to substantially encase said fuel distribution means for circulating cooling air thereabout, said air circulation means being formed to provide an elongated and deflected air gap along opposite edges thereof to direct vented air away from said tile members.

2. A heater apparatus according to claim 1, further comprising:

igniter means coupled to said fuel distribution means for igniting the fuel mixture continuously upon the surface of said tile members.

3. A heater apparatus according to claim 1, wherein:

said tile members are mounted upon said fuel distribution means; and said baffled compartmentalized chamber of said fuel distribution means is formed of a series of separate transverse compartments each aligned with respective ones of said tile members.

4. A heater apparatus according to claim 3, wherein said fuel distribution means comprises:

an elongated manifold rectangularly configured having a fuel inlet and a series of fuel outlets spaced along the length thereof; and manifold housing means adapted to contain said manifold longitudinally therein, the interior of said manifold housing means being separated into a plurality of transverse compartmental sections corresponding in number and relative position to the fuel outlets of said manifold member contained therein.

5. A heater apparatus according to claim 4, wherein said manifold housing means comprises:

an elongated U-shaped channel formed to contain said manifold and having a series of ledges extending along either side of said channel at its bifurcated end; and a plurality of U-shaped baffles transversely disposed and spaced apart throughout the interior of said channel to hold said manifold within the bifurcated frame of each baffle with the fuel outlets substantially centered between adjacent baffles.

6. A heater apparatus according to claim 5, wherein said fuel distribution means further comprises:

means coupled to said channel upon one of said series of ledges for diffusing the fuel mixture delivered to said tile members.

7. A heater apparatus according to claim 6, wherein said diffusing means comprises:

a pair of finely meshed screens spaced apart and mounted along the ledges of said channel.

8. A heater apparatus according to claim 7, wherein:

said tile members are mounted upon the uppermost one of said series of ledges of said channel, each of said tile members being rectangularly shaped and grouped together side-by-side in a continuous abutting relationship.

9. A heater apparatus according to claim 1, wherein said air circulation means comprises:

an elongated casing adapted to receive cooling air, said casing being transversely sized so that insertion there of said fuel distribution means provides the elongated air gap for venting along opposite edges thereof;

angled members mounted over and above the elongated air gap along each side of said casing to deflect vented air in opposite directions from said casing.

10. A heater apparatus according to claim 9, wherein said air circulation means further comprises:

a plate member formed to fit within said casing and rest therein, said plate member having a series of spaced holes along the length thereof to permit distribution of cooling air throughout said casing.

11. An apparatus for generating radiant heat from a single source of an ignitable fuel mixture, comprising:

an elongated porous panel of a refractory material, said panel including a plurality of rectangular tiles abutted together in a continuous series;

fuel distribution means in support of said panel and adapted to receive the fuel mixture for distribution thereof to said panel, said fuel distribution means having a baffled chamber of compartments transversely formed in correspondence with respective ones of said tiles; and igniter means coupled to said fuel distribution means for igniting the fuel mixture continuously upon the surface of said panel.

12. A radiant heater apparatus according to claim 11, wherein said fuel distribution means comprises:

an elongated manifold having a fuel inlet and a series of fuel outlets spaced apart along the length thereof;

manifold housing means for containing said manifold within an integral chamber separated into a plurality of transverse compartmental sections corresponding in number and relative position to the fuel outlets of said manifold member.

13. A radiant heater apparatus according to claim 12, wherein said manifold housing means comprises:

an elongated U-shaped channel formed to contain said manifold and having its bifurcated end adapted to hold said panel of tiles; and a plurality of U-shaped baffles transversely disposed and spaced apart throughout the interior of said channel so that said manifold is supported within the bifurcated frame of each baffle with the fuel outlets substantially centered between adjacent baffles.

14. A radiant heater apparatus according to claim 13, wherein said fuel distribution means further comprises:

a plurality of screen members supported upon the bifurcated end of said channel for diffusing the fuel mixture delivered to said panel of tiles.

15. A radiant heater apparatus according to claim 13, further comprising:

air circulation means adapted to encase said channel and formed relative thereto so that cooling air is directed about said channel and vented away from said panel of tiles through elongated gaps along opposite sides thereof.

16. A radiant heater apparatus according to claim 15, wherein said air circulation means comprises:

air jacket means for delivering cooling air to the exterior of said channel, said air jacket means being formed relative to said channel so that elongated gaps arc provided on either side of the bifurcated end of said channel; and deflector means coupled to said channel for deflecting air vented through the elongated gaps.

17. A radiant heater apparatus according to claim 16, wherein said air jacket means comprises:

an elongated casing adapted to receive cooling air, said casing being transversely sized relative to said channel to provide the elongated air gaps for venting along opposite sides thereof; and a plate member formed to fit within said casing and rest therein, said plate member having a series of spaced holes along the length thereof to permit distribution of cooling air throughout said casing.

18. A radiant heater apparatus according to claim 17, wherein said deflector means comprises:

angled members mounted over and above the elongated air gap along each side of said casing to deflect vented air in opposite directions.

19. A radiant heater apparatus supplied with a single source of an ignitable fuel mixture and a source of cooling air, comprising:

an elongated porous panel of a refractory material, said panel including a plurality of rectangular tiles abutted together in a continuous series;

fuel distribution means adapted to support said panel and coupled to said source of fuel mixture for distribution thereof to said panel of tiles, said fuel distribution means having a baffled chamber compartments transversely separated and integrally formed within said fuel distribution means in correspondence with respective ones of said tiles;

air circulation means adapted to encase said fuel distribution means and coupled to said source of cooling air for directing the cooling air about said fuel distribution means and away from said panel along opposite sides thereof; and igniter means coupled to said fuel distribution means for igniting the fuel mixture continuously upon the surface of said panel.

* * * * *